US007137911B2

(12) United States Patent
Giegerich

(10) Patent No.: US 7,137,911 B2
(45) Date of Patent: Nov. 21, 2006

(54) TABLE TENNIS BALL RETURN MECHANISM

(75) Inventor: Paul Giegerich, Maple Glen, PA (US)

(73) Assignee: DMI Sports, Inc., Fort Washington, PA (US)

( * ) Notice: Subject to any disclaimer, the term of this patent is extended or adjusted under 35 U.S.C. 154(b) by 0 days.

(21) Appl. No.: 11/100,692

(22) Filed: Apr. 7, 2005

(65) Prior Publication Data

US 2006/0229146 A1 Oct. 12, 2006

(51) Int. Cl.
*A63B 69/00* (2006.01)
*A63B 47/00* (2006.01)

(52) U.S. Cl. ..... 473/475; 473/494; 473/496; 473/459

(58) Field of Classification Search ..... 473/491, 473/494, 496, 475, 459
See application file for complete search history.

(56) References Cited

U.S. PATENT DOCUMENTS 4,971,319 A * 11/1990 Cutrone ..... 473/432
5,460,365 A * 10/1995 Payne ..... 473/494
5,470,057 A * 11/1995 Bodford, Jr. ..... 473/416
5,810,681 A * 9/1998 Heim ..... 473/496
6,050,625 A * 4/2000 Nisbet ..... 294/19.2
2005/0159251 A1* 7/2005 Houston et al. ..... 473/459

FOREIGN PATENT DOCUMENTS

DE 297 09 516 U1 * 12/1997
JP 10-192469 * 7/1998

* cited by examiner

*Primary Examiner*—Raleigh W. Chiu
(74) *Attorney, Agent, or Firm*—Akin Gump Strauss Hauer & Feld, LLP

(57) ABSTRACT

A ball return mechanism for use with a table tennis table for returning a ball to a player. The table tennis table includes a net, a first side and a second side located on opposite sides of the net. The ball return mechanism includes a first return line including a net end and a terminal end. The net end is mounted to the net at a first joint and the terminal end is located proximate a first end edge of the first side. A first guide mechanism holds the first return line in position away from a playing area of the table tennis table.

12 Claims, 4 Drawing Sheets

TABLE TENNIS BALL RETURN MECHANISM

BACKGROUND OF THE INVENTION

Table tennis has been played throughout the world for many years. Table tennis is a game played on a table in a manner similar to tennis. The table includes a net extending across the center of the playing surface and players are positioned on opposite ends of the table. The object of table tennis is to hit a ball over the net and onto an opposing player's side of the table such that the opposing player is unable to return the ball over the net, thereby scoring a point. During play, the ball often comes to rest at or near the net when the ball strikes the net before going over or otherwise rolls to the net. The table is typically sized such that a user is generally unable to reach from their side of the table to retrieve the ball when it is positioned at or near the net. Accordingly, players often have to walk to a side of the table near the net to retrieve the ball or lean over the table while reaching for the ball at the net. While reaching for and leaning on the table, the table may become damaged or the player may strain or injure themselves. It would be advantageous for a table tennis table to include a mechanism that automatically urges the ball away from the net and toward one of the players such that the player does not have to lean on or stretch across the table to retrieve the ball.

BRIEF SUMMARY OF THE INVENTION SECTION

Briefly stated, a preferred embodiment of the present invention is directed to a ball return mechanism for use with a table tennis table for returning a ball to a player. The table tennis table includes a net, a first side and a second side located on opposite sides of the net. The ball return mechanism includes a first return line including a net end and a terminal end. The net end is mounted to the net at a first joint and the terminal end is located proximate a first end edge of the first side. A first guide mechanism holds the first return line in position away from a playing area of the table tennis table.

In another aspect, a preferred embodiment of the present invention is directed to a ball return mechanism for use with a table tennis table including a net dividing the table tennis table into a first side and a second side. A first end edge is associated with the first side of the table and a second end edge is associated with the second side of the table. The ball return mechanism includes a ball return structure at least partially mounted proximate the net. The ball return mechanism urges the ball from a mid-line of the table tennis table toward one of the first end edge and the second end edge of the table tennis table.

In a further aspect, a preferred embodiment of the present invention is directed to a method for returning a table tennis ball to a player positioned at one of a first end edge and a second end edge of a table tennis table. The table tennis table has a first side, a second side and a net separating the first and second sides. The method includes the steps of locating the ball adjacent the net on the first side, activating an actuating mechanism adjacent the first end edge and mechanically urging the ball from the position adjacent the net on the first side with a ball return structure toward the first end edge to a first retrieving area such that a first player positioned proximate the first end edge is able to grasp the ball from the first retrieving area.

BRIEF DESCRIPTION OF THE SEVERAL VIEWS OF THE DRAWINGS

The forgoing summary as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE INVENTION

Figure 1:
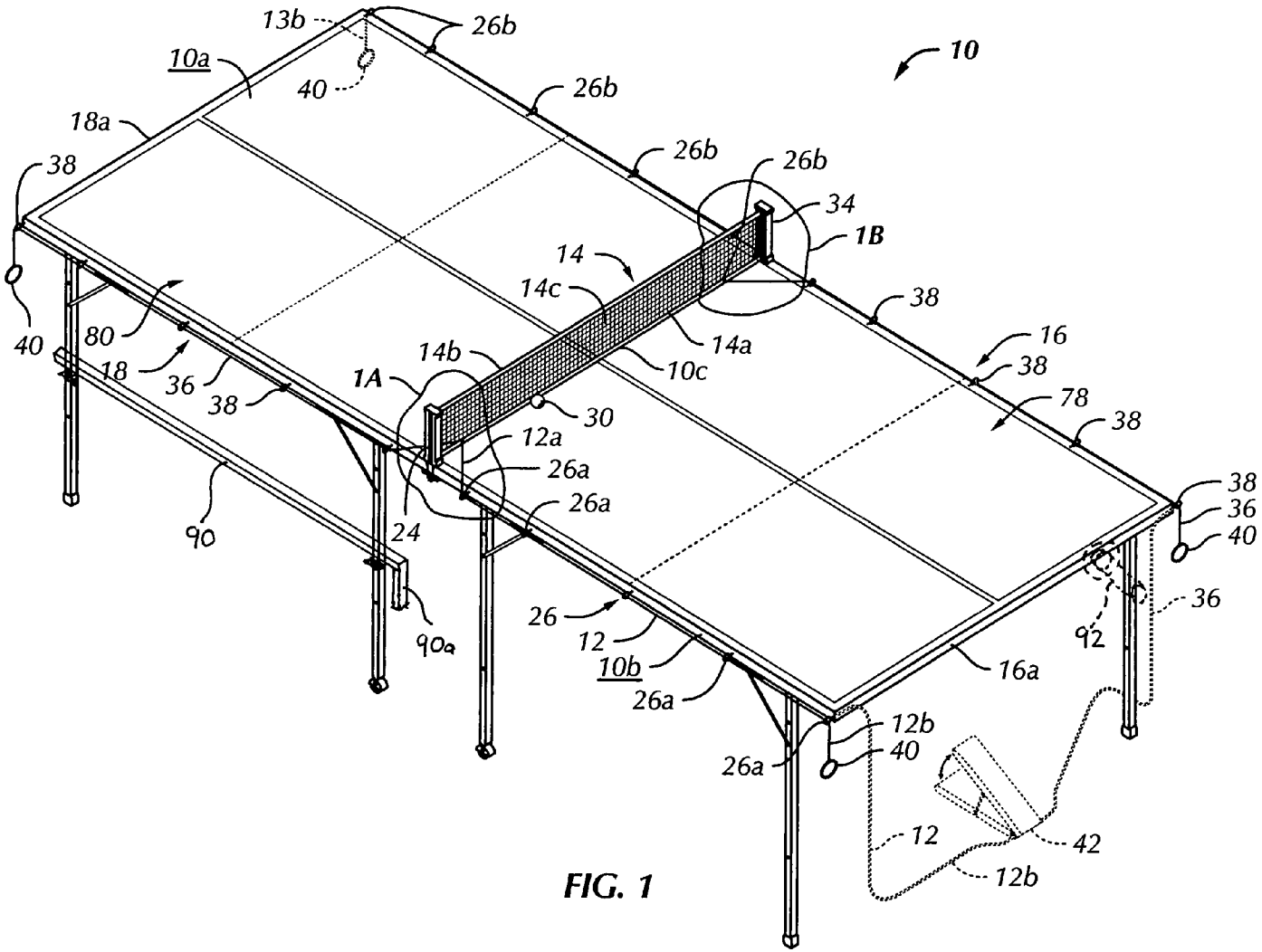
FIG. 1 is a top perspective view of a table tennis table including a ball return mechanism in accordance with a first preferred embodiment of the present invention.

Certain terminology is used in the following description for convenience only and is not limiting. The words, "right," "left," "lower" and "upper" designate directions in the drawings to which reference is made. The words "inwardly" and "outwardly" refer to directions toward and away from, respectively, the geometric center of the table tennis table, the ball return mechanism and designated parts thereof. The terminology includes the words above specifically mentioned, derivatives thereof and words of similar import. Additionally, the word "a", as used in the specification, means at least one.

Referring to FIG. 1, in a first preferred embodiment, a ball return mechanism for returning a ball 30 to a player is used with or associated with a table tennis table 10. The ball return mechanism includes a first return line 12 having a net end 12*a* and a terminal end 12*b*. The table tennis table 10 includes a net 14, a first side 16 and a second side 18. The first and second sides 16, 18 are located on opposite sides of the table 10 relative to the net 14. The table tennis table 10 has a generally rectangular shape with typical table tennis markings on an upper surface 10*a* that are generally well known to those having ordinary skill in the art. The table tennis table 10 is not limited to being generally rectangular and may have nearly any shape that is dividable by the net 14 such that the table 10 includes the first and second sides 16, 18 that are separated by the net 14.

Figure 1A:
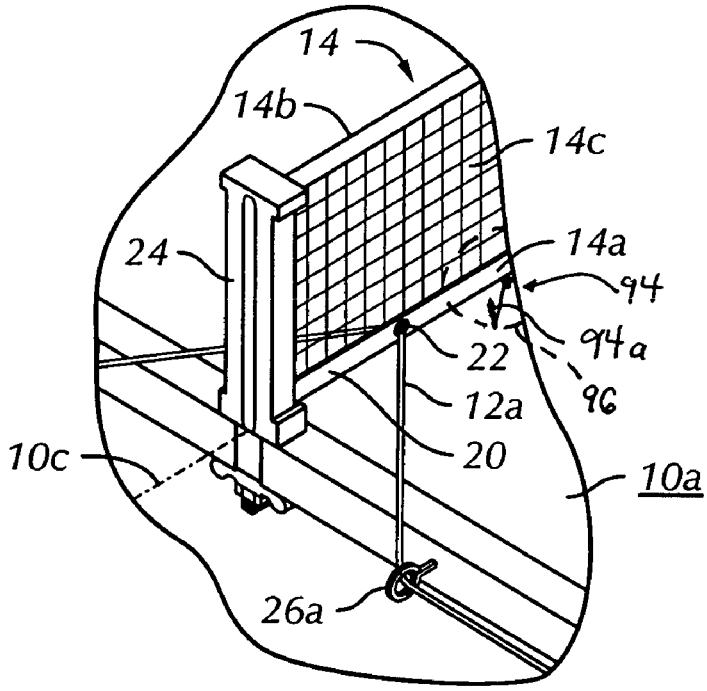
FIG. 1A is an enlarged top perspective view of a first net post, a net and a first return line of the ball return mechanism of FIG. 1, taken from within circles 1A of FIG. 1.
Figure 1B:
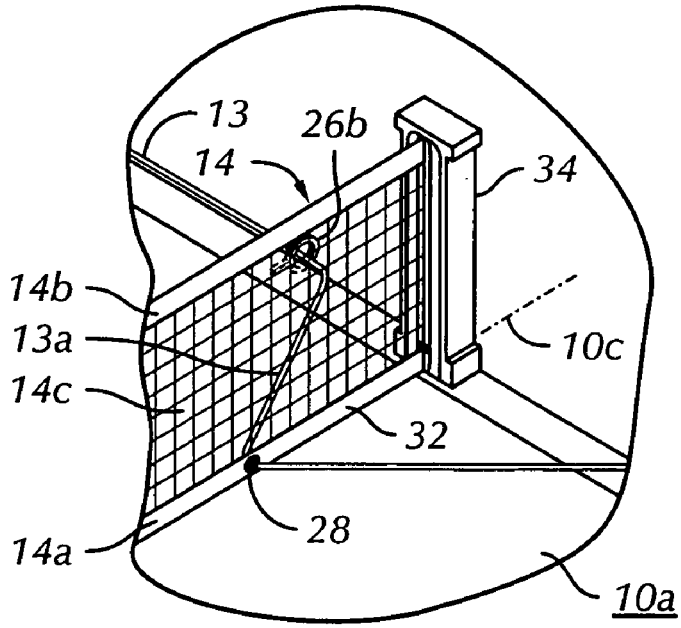
FIG. 1B is an enlarged top perspective view of a second net post, the net and an additional return line of the ball return mechanism of FIG. 1, taken from within circle 1B of FIG. 1.

Referring to FIGS. 1–1B, in the first preferred embodiment, the net end 12*a* of the first return line 12 is mounted to the net 14 at a first joint 22 and the terminal end 12*b* is located proximate a first end edge 16*a* of the first side 16. The first return line 12 is preferably constructed of a line that may be partially flexible but could be constructed of a cable, rope, wire, heavy string or the like that is flexible or partially bendable as long as the line 12 is able to carry a force to actuate the net 14. The first return line 12 is preferably long enough or flexible enough to accommodate or stretch to accommodate folding the table tennis table 10 into a storage position about a hinge (not shown) proximate a mid-line 10*c*, as is known in the art. The net end 12*a* is preferably mounted to a lower band 14*a* of the net 14 and the terminal end 12*b* is preferably located proximate the first end edge 16*a*. The first return line 12 is preferably continuous between the net and terminal ends 12*a*, 12*b* such that the first return line 12 is able to transmit a force between the terminal and net ends 12*b*, 12*a* through tension in the line 12. The first return line 12 is not limited to being generally bendable or flexible and may be rigid, as long as the line 12 is able to transmit a force between the terminal and the net ends 12*b*, 12*a*.

Referring to FIGS. 1 and 1A, a first elastic portion 20 is preferably comprised of a portion of the net 14 that extends at least from the first joint 22 to a first net post 24. The first elastic portion 20 is preferably constructed of a generally flexible material that stretches when a force is applied thereto and returns to its general original size and shape when the force is released. For example, the first elastic portion 20 is preferably constructed of a portion of the net 14, which is a woven material that flexes when a force is applied thereto. However, the first elastic portion 20 is not limited to being comprised of a portion of the net 14 and may be comprised of a separate component that is attached to the net 10 and may be constructed of a rubber band.

A first guide mechanism 26 preferably holds the first return line 12 in position away from the upper face or playing area 10*a* of the table tennis table 10. In the first preferred embodiment, the first guide mechanism 26 is comprised of a plurality of guide hoops 26*a* that are mounted to a first lateral side 10*b* of the table tennis table 10 between the net 14 and the first end edge 16*a*. The guide hoops 26*a* are fixed to the first lateral surface 10*b* such that the first return line 12 is spaced from the first lateral surface 10*b* and a user is able to apply a force at the first joint 22 by pulling on the terminal end 12*b*. The first guide mechanism 26 is not limited to the plurality of guide hoops 26*a* fixed to the first lateral surface 10*b* and may be comprised of a generally hollow tube secured to the first lateral surface 10*b*, a channel formed in the table tennis table 10 that extends from a position proximate the first end edge 16*a* to a position proximate the net 14 or any other like device or structure that permits positioning of the first return line 12 such that it extends from the net 14 to a position proximate the first end edge 16*a* such that the user is able to apply a force to the net 14 at the first joint 22 by pulling the first return line 12.

Referring to FIGS. 1 and 1B, in the first preferred embodiment, a second return line 13 including a base end 13*a* and a pull end 13*b* is mounted to the net 14 at a second joint 28. The pull end 13*b* is preferably located proximate a second end edge 18*a* of the second side 18. The second return line 13 is utilized by a second player to apply a force to the net 14 to urge the ball 30 toward the second end edge 18*a* if the ball 30 is stuck or is positioned proximate the net 14 on the second side 18. The second return line 13 is preferably constructed of the same material as the first return line 12 and is mounted to the table 10 in the same manner but is similarly not so limited.

A second elastic portion 32 is preferably constructed of a portion of the net 14 and extends at least from second joint 28 to a second net post 34. The second elastic portion 32 is preferably constructed of the same or a similar material to the first elastic portion 20 but is not so limited. The second elastic portion 32 preferably permits flexing of the net 14 or some mechanism that acts on the ball 30 to urge the ball 30 toward the second end edge 18*a* when a pulling force is applied to the second return line 13. The second return line 13 is preferably positioned relative to the table 10 by a second guide mechanism 26*b*, which is comprised of a second plurality of guide hoops 26*b* that hold the line 13 in position away from the playing area 10*a* of the table 10. The second guide portion or guide hoops 26*b* are preferably constructed and operate in a similar manner to the guide hoops 26*a* associated with the first return line 12 but are likewise not so limited.

Referring to FIG. 1, the table tennis table 10 may also include additional return lines 36 positioned relative to the table 10 by additional guide hoops 38 that are mounted off of the playing surface 10*a*. The additional return lines 36 are preferably mounted such that one end engages either the first or second joints 22, 28 and their terminal ends are positioned proximate the first end edge 16*a* or the second end edge 18*a*. The additional return lines 36 and guide hoops 38 are preferably constructed in a similar manner to the above-described first and second return lines 12, 13 and first and second guide mechanisms 26, 26*b* but are likewise not so limited. The additional return lines 36 and guide hoops 38 are utilized to provide a return mechanism to a player regardless of which corner of the preferred table tennis table 10 the player is positioned at, as will be obvious to one having ordinary skill in the art.

Referring to FIGS. 1–1B, in the preferred embodiment, the net 14 is mounted to the table 10 between the first net post 24 and the second net post 34. The net 14 includes an upper band 14*b*, the lower band 14*a* and a mesh net section 14*c* therebetween. In the first preferred embodiment, the first elastic portion 20 comprises at least a portion of the lower band 14*a* proximate the first net post 24. The first and second elastic portions 20, 32 are elastic in that they are able to deform under an applied force and return to a form or position similar to their initial form or position when the force is released, as is common for materials that are typically used to construct the net 14 for a table tennis table. Specifically, the first elastic portion 20 preferably comprises at least the portion of the lower band 14*a* between the first joint 22 and the attachment of the lower band 14*a* to the first net post 24. Positioning the first elastic portion 20 between the first net post 24 and the first joint 22 permits the lower band 14*a* to flex toward the first end edge 16*a* when a user applies a force to the first return line 12, thereby moving the lower band 14*a* toward the first end edge 16*a* and urging the ball 30 toward the first end edge 16*a* if the ball is in contact with or proximate the lower band 14*a*. Preferably, the lower band 14*a* applies a force to the ball 30 such that the ball 30 rolls toward the player positioned at the first end edge 16*a*. When the force is released from the first return line 12, the lower band 14*a* typically returns to a position near its initial, unloaded position. This may be accomplished by loosely mounting the net 14 between the first and second net posts 24, 34 such that the application of the force to the first return line 12 moves the lower band 14*a* toward the first end edge

16*a* and releasing the force permits the lower band 14*a* to move toward or to its initial, unloaded position.

The first elastic portion 20 may comprise the entire lower band 14*a* and may extend between the first net post 24 and the second net post 34. The first elastic portion 20, which comprises the entire lower band 14*a*, is convenient for the manufacture of the lower band 14*a* using one material. However, the first elastic portion 20 is not limited to comprising the entire lower band 14*a* and may comprise only a generally elastic portion between the first joint 22 and the first post 24. In addition, the first elastic portion 20 is not limited to comprising any portion of the lower band 14*a* and may be separate from the lower band 14*a* as long as either the lower band 14*a* or a separate band or mechanism proximate the lower band 14*a* is able to apply a force to the ball 30 in a direction toward the first end edge 16*a* when the first return line 12 is pulled or otherwise actuated by a player. One have ordinary skill in the art will realize that the second elastic portion 32 preferably has a similar construction when compared to the first elastic portion 20.

In the first preferred embodiment, the first return line 12 is comprised of a pull string 12 having a pull ring 40 mounted to the terminal end 12*b*. The player or user is able to grasp the pull ring 40 to pull the pull string 12 and actuate the first elastic portion 20 and lower band 14*a* to urge the ball 30 toward the first end edge 16*a*. The second return line 13 and the additional return lines 36 also preferably include a pull ring 40 proximate either the first or second end edges 16*a*, 18*a*, respectively. The pull rings 40 are preferably grasped by the player to apply a force away from the net 14 at the first or second joints 22, 28 such that the first or second elastic portions 20, 32 flex to move the lower band 14*a* or another mechanism toward the ball 30 and urge the ball 30 toward the first or second end edges 16*a*, 16*b* into the reach of the player. The pull rings 40 are not limiting and are preferred for the convenience of the players, as would be obvious to one having ordinary skill in the art.

Referring to FIG. 1, the terminal end 12*b* of the first return line 12, as is shown in dashed linetype, may also be mounted to a foot pedal 42 proximate the first end edge 16*a* of the first side 16. A user may depress the foot pedal 42 to actuate the first return line 12 to pull the first elastic portion 20, thereby urging the ball 30 toward the first end edge 16*a*. The foot pedal 42 may also be mounted to the end of any of the additional return lines 36 or to the base end 13*a* of the second return line 13 to actuate the first or second elastic portions 20, 32 and urge the ball 30 toward the first or second end edge 16*a*, 18*a*. In addition, the return lines 12, 13, 36 associated with the first or second sides 16, 18 may be mounted to the foot pedal 42 such that actuation of the foot pedal by the player urges the ball 30 toward the first or second end edges 16*a*, 18*a*, respectively. The ball return mechanism for the table tennis table 10 is not limited to inclusion of the foot pedal 42 and may be otherwise constructed such that a user is able to urge the ball 30 toward the first or second end edges 16*a*, 18*a* when the ball 30 is positioned or stuck proximate the net 14, as will be obvious to one having ordinary skill in the art.

In the first preferred embodiment, the net 14 is mounted proximate the mid-line 10*c* of the table tennis table 10. The ball return mechanism preferably urges the ball 30 toward the first or second end edges 16*a*, 18*a* upon the urging of one of the players. For example, pulling the terminal end 12*b* of the first return line 12 actuates the first elastic portion 20 to flex toward the first end edge 16*a* causing the lower band 14*a* or another line or mechanism adjacent the lower band 14*a* to move toward the first end edge 16*a* and to urge the ball 30 toward the first end edge 16*a*. Alternatively, the lower band 14*a* or any other portion of the net 14 may be urged, preferably pushed, by a retrieving rod 90 toward the first end edge 16*a* by a player positioned proximate the second end edge 18*a*. That is, a player positioned proximate the second end edge 18*a* grasps the return rod 90 and pushes on a side of the net 14 facing the second end edge 18*a* to urge the net 14 and the ball 30, which is located proximate the net 14 on the first side 16 toward the first end edge 16*a*. The return rod 90 may include a hook end 90*a* that is able to hook or pull the ball 30 toward a user for retrieving the ball 30, as would be obvious to one having ordinary skill in the art.

Figure 2:
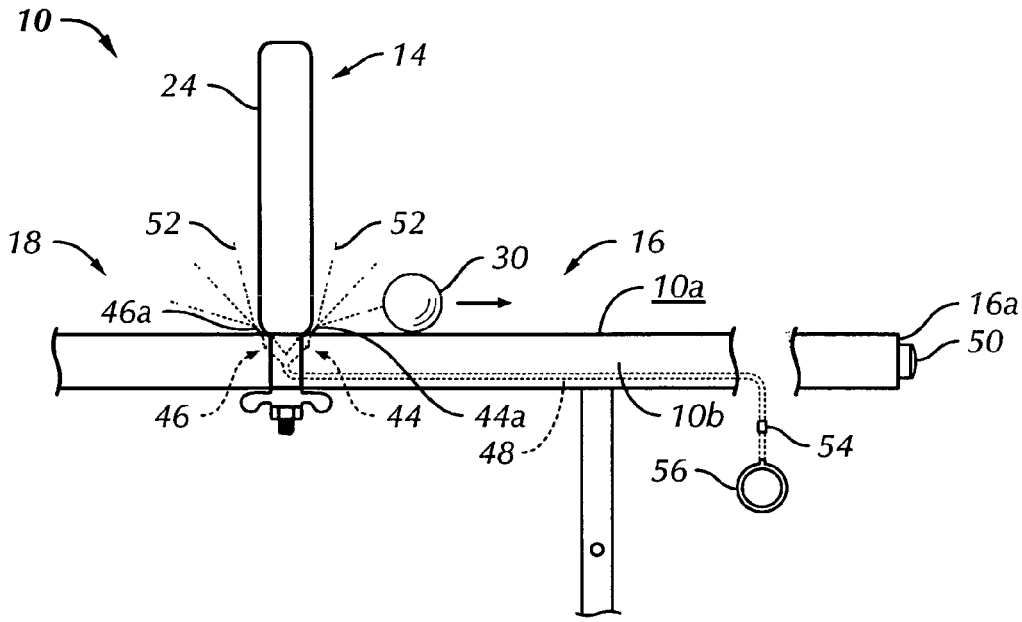
FIG. 2 is a greatly enlarged partial side elevational view of a ball return mechanism for a table tennis table in accordance with a second preferred embodiment of the present invention.

Referring to FIG. 2, in a second preferred embodiment, the ball return structure is comprised of a first air jet 44, a second air jet 46, an air feed line 48 and an actuating mechanism 50. The first and second air jets 44, 46 are preferably mounted to the table tennis table 10 proximate the net 14. The first and second air jets 44, 46 preferably include a first nozzle 44*a* and a second nozzle 46*a*, respectively. The first nozzle 44*a* is preferably oriented to urge a stream of air 52 toward the first end edge 16*a* of the table 10 and the second nozzle 46*a* is preferably oriented to urge a stream of air 52 toward the second end edge 18*a* of the table 10. In the second preferred embodiment, the first and second nozzles 44*a*, 46*a* preferably extend above the playing surface 10*a* proximate the net 14 and are directed to project the stream of air 52 toward the first or second end edges 16*a*, 18*a*, respectively. The first and second air jets 44, 46 are preferably in communication with the air feed line 48. In the preferred embodiment, the air feed line 48 is in communication with a pressurized air source 56 and includes a valve 54. However, the air feed line 48 is not limited to being in communication with a pressurized air source 56 and may be in direct communication with a bellows, hand pump or foot pump for urging a stream of air into the air feed line 48 and out of the air jets 44, 46. The pressurized air source 56 provides a source of air to the air feed line 48 that may be directed to the first and second air jets 44, 46 and through the first and second nozzles 44*a*, 46*a* to provide the stream of air 52. The air source 56 is preferably comprised of a pressure vessel for storing a volume of pressurized air but is not so limited. For example, the air source 56 may be comprised of a hand pump, foot pump, bellows or like mechanism that is able to direct a flow of air into the air feed line 48.

The first and second nozzles 44*a*, 46*a* may extend along the entire length of the net 14 between the first and second net posts 24, 34 or may be comprised of a series of first and second individual nozzles 44*a*, 46*a* that are positioned proximate the net 14 between the first and second net posts 24, 34. Regardless of the configuration of the first and second air jets 44, 46 and first and second nozzles 44*a*, 46*a*, it is preferred that the stream of air 52 projecting from the first and second nozzles 44*a*, 46*a* urges the ball 30 toward the first or second end edges 16*a*, 18*a* when the ball 30 is positioned proximate the net 14 regardless of where along the net 14 the ball 30 is located.

The actuating mechanism 50 of the second preferred embodiment is preferably mounted to the table tennis table 10 proximate the first end edge 16*a* and is comprised of a first button 50. To actuate the stream of air 52 from the first and/or second nozzles 44*a*, 46*a*, the user or player preferably depresses the button 50 to open the valve 54 and permit air to flow from the pressurized air source 56, through the air feed line 48, to the first and second air jets 44, 46 and out the first and second nozzles 44*a*, 46*a*. The actuating mechanism 50 is not limited to a button 50 and may be comprised of a handle (not shown) that actuates the valve 54 or any other mechanism that permits a player to actuate the stream of air 52 to flow from the first and second nozzles 44*a*, 46*a*. In addition, the second preferred embodiment is not limited to a single actuating mechanism 50 position proximate the first end edge 16*a* and may include an actuating mechanism (not shown) positioned proximate the second end edge 18*a* or nearly anywhere proximate the table 10 that permits a player, user or other individual to actuate the stream of air 52 to urge the ball 30 toward the first or second end edges 16*a*, 18*a*.

Figure 3:
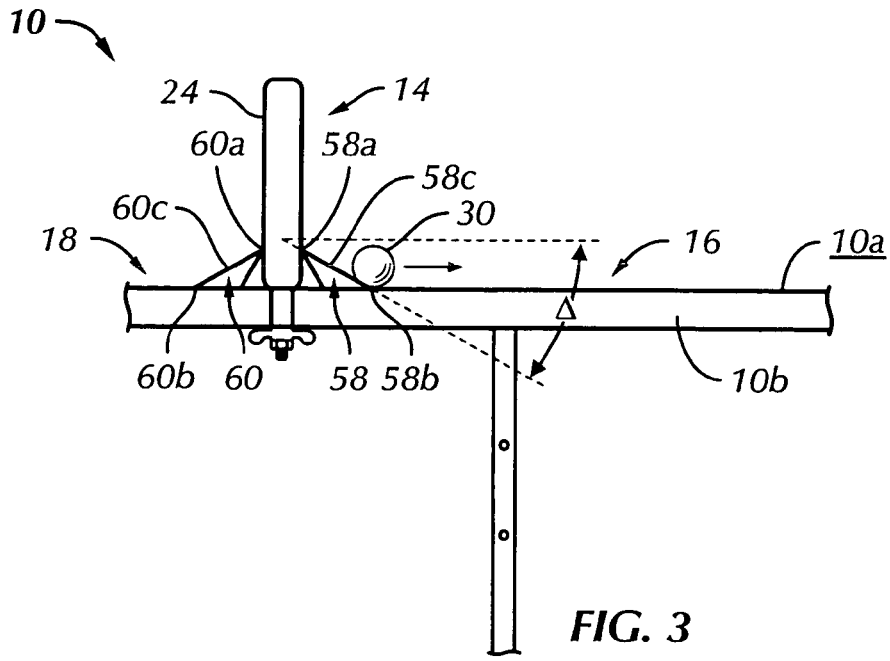
FIG. 3 is a greatly enlarged partial side elevational view of a ball return mechanism for a table tennis table in accordance with a third preferred embodiment of the present invention.

Referring to FIG. 3, in a third preferred embodiment, the ball return structure is comprised of a first angled piece 58 mounted to the table tennis table 10 adjacent the net 14 on the first side 16 and a second angled piece 60 mounted to the table 10 adjacent the net 14 on the second side 18. The first angled piece 58 includes a first apex 58*a* adjacent the net 14 and a first foot 58*b* spaced from the net 14. The second angled piece 60 preferably includes a second apex 60*a* adjacent the net 14 and a second foot 60*b* spaced from the net 14. The first and second angled pieces 58, 60 preferably extend adjacent the net 14 between the first and second net posts 24, 34. The first angled piece 58 preferably includes a first ramp 58*c* extending between the first apex 58*a* and the first foot 58*b* and the second angled piece 60 preferably includes a second ramp 60*c* extending between the second apex 60*a* and the second foot 60*b*. The first and second apexes 58*a*, 60*a* are preferably positioned adjacent the net 14 and the first and second ramps 58*c*, 60*c* extend downwardly between the first and second apexes 58*a*, 60*a* and the first and second feet 58*b*, 60*b* to urge the ball 30 toward the first and second end edges 16*a*, 18*a* when the ball 30 is adjacent the net 14. The first and second ramps 58*c*, 60*c* preferably extend linearly between the first and second apexes 58*a*, 60*a* and the first and second feet 58*b*, 60*b*. However, the first and second ramps 58*c*, 60*c* are not limited to being generally linear and may be curved in a convex or concave manner or otherwise shaped, as long as the ball is urged from the first and second apexes 58*a*, 60*a* toward the first and/or second feet 60*a*, 60*b* when the ball 30 is on the first and/or second ramps 58*c*, 60*c*. In addition, the first and second ramps 58*c*, 60*c* may have various curves and lengths between the apexes 58*a*, 60*a* and the feet 58*b*, 60*b* to direct the ball 30 to various areas on the playing surface 10*a*, as would be obvious to one of skill in the art.

In the third preferred embodiment, the first and second ramps 58*c*, 60*c* extend downwardly from the first and second apexes 58*a*, 60*a* to the first and second feet 58*b*, 60*b* at a return angle Δ. The return angle Δ is preferably in the range of 15 to 70 degrees (15–70°). The ball 30 is urged toward the first or second end edge 16*a*, 18*a* of the table 10 by the force of gravity when the ball 30 is positioned on the first or second ramp 58*c*, 60*c*. Accordingly, when the ball 30 is positioned on one of the first or second ramps 58*c*, 60*c*, the ball 30 is urged by the force of gravity toward one of the players positioned at the first or second end edges 16*a*, 18*a* and away from the net 14 where the ball 30 is typically difficult to reach.

Figure 4:
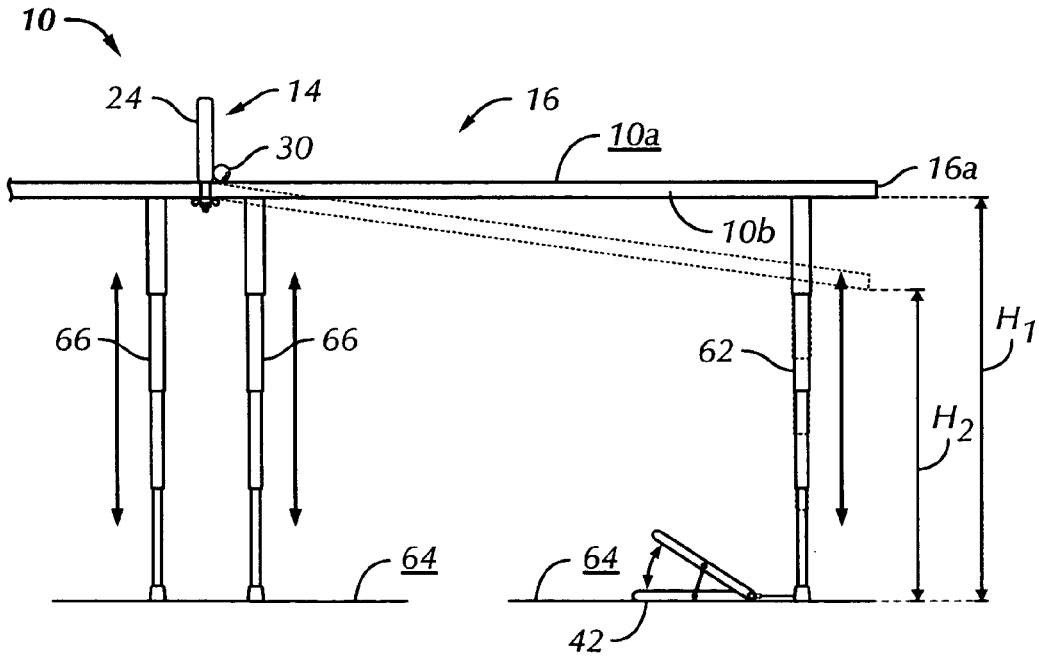
FIG. 4 is an enlarged partial side elevational view of a ball return mechanism for a table tennis table in accordance with a fourth preferred embodiment of the present invention.

Referring to FIG. 4, in a fourth preferred embodiment, the ball return structure is comprised of a first table leg 62 having a first leg height $H_1$. The first table leg 62 is mounted to the table tennis table 10 and the height of the first leg 62 is variable to pitch the playing surface 10*a* of the first side 16 toward the first end edge 16*a*. In the preferred embodiment, when the first leg 62 is positioned at the first height $H_1$, the playing surface 10*a* is generally parallel to a support surface 64. When the first table leg 62 is at the first leg height $H_1$, the game may be played with the playing surface 10*a* being generally parallel to the support surface 64.

The first leg 62 is preferably mounted to the table 10 proximate the first end edge 16*a*. The first table leg 62 is preferably movable to a second leg height $H_2$, wherein the first leg height $H_1$ is greater than the second leg height $H_2$. The first table leg 62 is preferably at the first leg height $H_1$ while the table tennis game is being played and is temporarily actuated to the second leg height $H_2$ to pitch the first side 16 toward the first end edge 16*a* and urge the ball 30 from the net 14 or anywhere on the playing surface 10*a* on the first side 16 toward the first end edge 16*a*. The first leg 62 may be actuated to and between the first and second heights $H_1$, $H_2$ by a foot pedal 42 or other mechanism that is able to move the first leg 62 to and between the first and second heights $H_1$, $H_2$ when desired by a user. For example, the first leg 62 may be biased by an internal spring (not shown) to the first height $H_1$ and may be moved to the second height $H_2$ against the force of the spring when a user applies a downward force to the playing surface 10*a* proximate the first end edge 16*a*. The first table leg 62 may also be otherwised moveable between the first and second heights $H_1$, $H_2$ in a number of different manners that would be obvious to one having ordinary skill in the art, for example, the first leg 62 may roll or slide away from the net 14 at its bottom while remaining attached to an underside of the table 16 at its top. The table 10 is preferably hinged proximate the net 14 such that the first side 16 pitches when the height of the first table leg 62 is altered between the first and second heights $H_1$, $H_2$.

The table 10 of the fourth preferred embodiment is not limited to having a variable height first table leg 62 proximate the first end edge 16*a* and may include a variable height leg (not shown) proximate the second end edge 18*a*. In addition, the table 10 of the fourth preferred embodiment may include middle legs 66 that have a variable height to pitch the first and/or second sides 16, 18 toward the first or second end edges 16*a*, 18*a*, respectively. The modification of the height of the middle legs 66 to pitch the first and second sides 16, 18 of the table 10 toward the first or second end edges 16*a*, 18*a* is preferably similar to or the same as the first table legs 62, as will be obvious to one having ordinary skill in the art.

Figure 5:
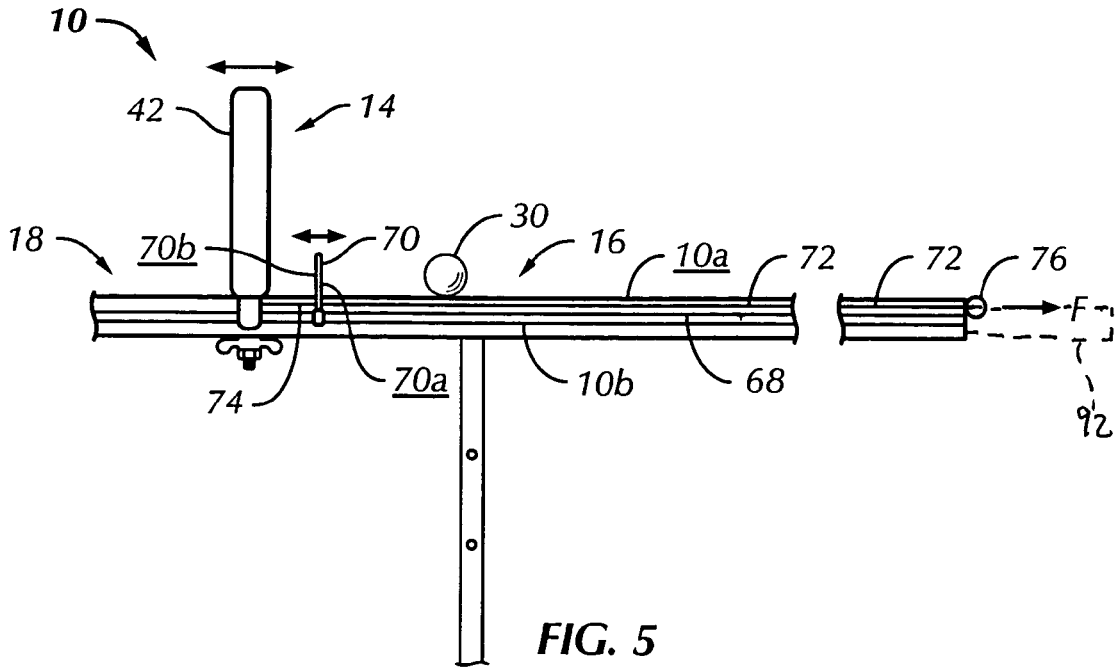
FIG. 5 is a greatly enlarged partial side elevational view of a ball return mechanism for a table tennis table in accordance with a fifth preferred embodiment of the present invention.

Referring to FIG. 5, in a fifth preferred embodiment, the ball return structure is comprised of a guide rod 68 mounted proximate a first lateral surface 10*b* of the table tennis table 10 and a slider 70 slideably mounted to the guide rod 68. The slider 70 is moveable from a net position to a return position. The slider 70 is located proximate the net 14 in the net position and is located proximate the first end edge 16*a* in the return position. The slider 70 preferably extends across the table 10 from the first net post 24 to the second net post 34 in the net position. In addition, the slider 70 is preferably secured to a second guide rod (not shown) at an opposite side of the table 10 from the guide rod 68. The slider 70 is actuated to move from the net position toward the return position when a player activates an actuating mechanism (not shown). For example, the slider 70 may be driven from the net position toward the return position by a linear actuator, hydraulic pressure or pneumatic pressure that moves the slider 70 from the net position toward the return position. Alternatively, the slider 70 may be urged by a mechanical actuator (not shown) that is actuated by a rotatable handle 92 or by the return rod 90. The slider 70 is preferably guided in its movement to and between the net position and the return position by the guide rod 68. As the slider 70 moves from the net position toward and to the return position, the slider 70 preferably contacts and moves the ball 30 from a position proximate the net 14 or anywhere on the playing surface 10*a* on the first side 16 toward the first end edge 16*a*.

In the fifth preferred embodiment, a pull string 72 is preferably mounted to a first face 70*a* of the slider 70 and an elastic string 74 is preferably mounted to a second face 70*b* of the slider 70. The first face 70*a* faces the first end edge 16*a* and the second face 70*b* faces the net 14. The elastic string 74 biases the slider 70 toward the net position and the pull string 72 is actuable by a user or player to move the slider 70 from the net position toward the return position. The elastic string 74 is preferably constructed of a flexible, polymeric material, such as a rubber band-like material that biases the slider 70 toward the net position but flexes to allow the slider 70 to move toward the return position. The pull string 72 is preferably constructed of a string-like material that allows a user to apply a force to the pull string 72 away from the net 14 to urge the slider 70 from the net position toward the return position against the bias of the elastic string 74. Alternately, the slider 70 may be actuated by the mechanical actuator that is in communication with the rotatable handle 90 to move the slider 70 to and between the net and return positions to push or pull the ball 30 toward the first or second end edge 16*a*, 18*a*. The mechanical actuator may be constructed in a similar manner to a similar actuator that is typically associated with a bubble hockey-type game table, which is known by one having ordinary skill in the art.

The player preferably actuates the slider 70 to move from the net position toward the return position by applying a force F to the string 72 away from the net 14. For example, a pull ring 76 may be mounted to a terminal end of the pull string 72 such that a user is able to grasp the pull ring 76 and apply the force F to the string 72 away from the net 14. The slider 70 is preferably guided in its movement by the guide rod 68 and contacts and urges the ball 30 from a position proximate the net 14 toward the first end edge 16*a* as the slider 70 moves from the net position toward the return position. Alternatively, the slider 70 may be actuated by actuating the mechanical actuator using the handle 92 or by pushing or pulling on the slider 70 using the return rod 90.

The table tennis table 10 of the fifth preferred embodiment is not limited to inclusion of the slider 70 and may include a net 14 that is moveable upon an urging by the player toward or away from the first end edge 16*a*. The moveable net 14 is preferably utilized to urge the ball 30 toward the first end edge 16*a* when the ball 30 is on the first side 16 and out of reach of the player. The moveable net 14 may also be used to handicap a table tennis game by narrowing the playing surface 10*a* on either the first or second sides 16, 18 such that it is more difficult for one player to land the ball 30 on the smaller of the first or second sides 16, 18, as would be obvious to one having ordinary skill in the art. However, it is preferred that the moveable net 14 of the fifth preferred embodiment is utilized to move the ball 30 toward the first or second end edge 16*a*, 18*a*. The movable net 14 of the fifth preferred embodiment is typically not associated with the elastic string 74 such that the net 14 remains in a position on the table 10, which may not be at the mid-line 10*c* for handicapping purposes.

Referring to FIGS. 1 and 1A, the handle 92 may be associated with a rotatable arm 94 that is mounted to the table tennis table 10 proximate the net 14 and includes a vertical projection 94*a* on its end. The rotatable arm 94 is preferably rotatable relative to the table 10 and the net 14 such that the vertical projection 94*a* impacts and pushes or pulls the lower band 14*a* away from the mid-line 10*c* during its rotation. Accordingly, a player may actuate the rotatable arm 94 by turning the handle 92 such that the arm 94 rotates, the vertical projection 94*a* impacts and moves the lower band 14*a* and the lower band 14*a* urges the ball 30 away from the net 14 and toward the first or second end edges 16*a*, 18*a*. The rotatable arm 94 is not limited to being rotatable and may move linearly or in nearly any manner that flexes the net 14 to urge the ball 30 away from the net 14 toward the first or second end edges 16*a*, 18*a* when the ball 30 is located or stuck near the net 14. The rotatable arm 94 may also be associated with the slider 70 or the movable net 14, as would be obvious to one having ordinary skill in the art.

Referring to FIGS. 1–5, in operation, a table tennis player is positioned on either side 16, 18 of the table 10 proximate the first or second end edges 16*a*, 18*a*, respectively. The players hit the ball over the net 14 until a point is scored. If the ball 30 hits the net 14 and comes to rest adjacent the net 14, out of reach of one of the players, the ball return mechanism is utilized. Specifically, if the ball 30 is positioned proximate the net 14 on the first side 16, the ball return mechanism is actuated and urges the ball 30 from the position adjacent the net 14 on the first side 16 to a first retrieving area 78 such that a first player positioned proximate the first end edge 16*a* is able to grasp the ball 30 from the retrieving area. In the first retrieving area 78, the ball 30 is preferably within arms-length reach of the first player. The table 10 also preferably includes a second retrieving area 80 proximate the second end edge 18*a* where the ball 30 is within arms-length reach of the second player positioned proximate the second end edge 18*a*.

Referring to FIG. 1, in the first preferred embodiment, when the ball 30 is positioned proximate the net 14 on the first side 16 and out of arms-length reach of the first player, a force is applied to the first return line 12 and/or an additional return line 36 using the pull ring 40. The force is transmitted through the lines 12, 36 to the first and/or second joints 22, 28 such that the first elastic portion 20 and/or the second elastic portion 32 flexes toward the first end edge 16*a*. The lower band 14*a* or another band or wire secured between the first and second elastic portions 20, 32 is also urged toward the first end edge 16*a* to urge the ball 30 toward the first retrieving area 78. Actuation of the lines 12, 36 preferably causes the ball 30 to roll into the first retrieving area 78 such that the first player is able to grasp the ball 30 from the first end edge 16*a* without stretching or leaning on the table 10 and the game may be commenced. The actuation and operation of the ball return mechanism on the second side 18 is obvious to one having ordinary skill in the art based upon the above-referenced description of the operation on the first side 16.

Referring to FIG. 2, in the second preferred embodiment, when the ball 30 is positioned or stuck proximate the net 14 on the first or second sides 16, 18, a user actuates the first and/or second air jets 44, 46 by depressing the first button 50 which opens the valve 54. Air flows from the pressurized air source 56 through the air feed line 48 and out of the first and/or second nozzles 44*a*, 46*a* as the stream of air 52. The stream of air 52 preferably urges the ball 30 toward the first or second end edges 16*a*, 18*a* and into the first or second retrieving area 78, 80 for the user to retrieve.

Referring to FIG. 3, if the ball 30 is positioned proximate the net 14 in the third preferred embodiment, the ball 30 rolls down the ramp 58*c*, 60*c* toward the first or second feet 58*b*, 60*b* and the first and/or second end edge 16*a*, 18*a*. The first and/or second ramps 58*c*, 60*c* preferably urge the ball 30 into the first and/or second retrieving areas 78, 80 through the force of gravity.

Referring to FIG. 4, in the fourth preferred embodiment, when the ball 30 becomes lodged or is positioned proximate the net 14 out of arms-length reach of the players, the first table leg 62 is actuated to move from the first leg height $H_1$ to the second leg height $H_2$. When the first table leg 62 is at the second leg height $H_2$, the playing surface 10*a* on the first side 16 is pitched toward the first end edge 16*a* and the ball 30 is urged through the force of gravity toward the first end edge 16*a*. The first table leg 62 may be actuated to change its height by the foot pedal 42. Alternatively, the middle legs 66 may be moved such that their height changes and the table 10 is pitched such that the ball 30 moves toward the first or second end edge 16*a*, 18*a*.

Referring to FIG. 5, in the fifth preferred embodiment, when the ball 30 is out of arms-length reach of one of the players, the slider 70 is preferably actuated by applying the force F to the pull rings 76. The force F is transmitted through the pull string 72 to urge the slider 70 toward the first end edge 16*a* and push the ball 30 towards the first end edge 16*a*. The slider 70 is guided in its movement by at least the guide rod 68 and is biased toward a net position by the elastic string 74. Accordingly, when the force F is released from the pull ring 76, the slider 70 is urged back to its net position by the elastic string 74. Alternatively, the net 14 itself may be moved similar to the slider 70 and guided by the guide rod 68 to urge or push the ball 30 toward the first or second end edges 16*a*, 18*a*, as would be obvious to one having ordinary skill in the art. The slider 70 or net 14 may also be actuated to move by the handle 92 and rotating arm 94 or the retrieving rod 90.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

I claim:

1. A ball return mechanism for use with a table tennis table for returning a ball to a player, the table tennis table including a net, a first side and a second side located on opposite sides of the net, the ball return mechanism comprising:

a first return line including a net end and a terminal end, the net end being mounted to the net at a first joint, the terminal end being located proximate a first end edge of the first side; and a first guide mechanism holding the first return line in a position away from a playing area of the table tennis table.

2. The ball return mechanism of claim 1 further comprising:

a first elastic portion adjacent the net, the first elastic portion extending at least from the first joint to a first net post.

3. The ball return mechanism of claim 2 wherein the net is mounted to the table tennis table between the first net post and a second net post, the net including an upper band, a lower band and a mesh net section therebetween, the first elastic portion comprising at least a portion of the lower band proximate the first net post.

4. The ball return mechanism of claim 3 wherein the first elastic portion is comprised of the entire lower band.

5. The ball return mechanism of claim 1 wherein the first return line is comprised of a pull string having a pull ring mounted to the terminal end, whereby a user grasping and pulling the pull ring actuates the net to urge the ball toward the first end edge.

6. The ball return mechanism of claim 1 wherein the first guide mechanism is comprised of a plurality of guide hoops mounted to a first lateral surface of the table tennis table between the net and the first end edge.

7. The ball return mechanism of claim 1 further comprising:

a second return line including a base end and a pull end, the base end being mounted to the net at a second joint, the pull end being located proximate a second end edge of the second side;

a second elastic portion adjacent the net, the second elastic portion extending at least from the second joint to a second net post; and a second guide mechanism holding the second return line in a position away from a playing area of the table tennis table.

8. The ball return mechanism of claim 1 wherein the terminal end of the first return line is mounted to a foot pedal proximate the first end edge of the first side, whereby a user depressing the foot pedal actuates the net, thereby urging the ball toward the first end edge of the first side.

9. A method for returning a table tennis ball to a player positioned at one of a first end edge and a second end edge of a table tennis table, the table tennis table having a first side, a second side and a net separating the first and second sides, the method comprising the steps of:

a) locating the ball adjacent the net on the first side;

b) activating an actuating mechanism adjacent the first end edge; and c) mechanically urging the ball from the position adjacent the net on the first side with a ball return structure toward the first end edge to a first retrieving area such that a first player positioned proximate the first end edge is able to grasp the ball from the first retrieving area.

10. The method of returning a table tennis ball of claim 9 wherein the ball is within arms-length reach of the first player in the first retrieving area of step (c).

11. The method of returning a table tennis ball of claim 9 wherein the ball is urged in step (c) toward the first end edge by impacting the net with a rotatable arm when at least one of a first player positioned at the first end edge and a second player positioned at the second end edge rotates a handle that is mounted to one of the first and second end edges.

12. The method of returning a table tennis ball of claim 9 wherein the ball is urged in step (c) toward the first end edge with a retrieving rod by a second player positioned at the second end edge by pushing on the net on a side facing the second end edge proximate the ball.

* * * * *